US007435290B2

(12) United States Patent
Lane et al.

(10) Patent No.: US 7,435,290 B2
(45) Date of Patent: Oct. 14, 2008

(54) CENTRIFUGAL GAS/LIQUID SEPARATORS

(75) Inventors: Patrick W Lane, Nottingham (GB); Kevin A Burke, Derby (GB); Benjamin J Loret, Derby (GB); Farhana J Preston, Derby (GB); Alastair Currie, Bristol (GB); Philippe E Christol, Derby (GB)

(73) Assignee: Rolls-Royce plc, London (GB)

( * ) Notice: Subject to any disclaimer, the term of this patent is extended or adjusted under 35 U.S.C. 154(b) by 537 days.

(21) Appl. No.: 11/137,447

(22) Filed: May 26, 2005

(65) Prior Publication Data

US 2005/0284299 A1 Dec. 29, 2005

(30) Foreign Application Priority Data

Jun. 26, 2004 (GB) ..... 0414344.2

(51) Int. Cl.
*B01D 19/00* (2006.01)

(52) U.S. Cl. ..... 96/210; 96/212; 95/261; 55/460

(58) Field of Classification Search ..... 96/210, 96/209, 212; 95/261; 55/460, 459.1
See application file for complete search history.

(56) References Cited

U.S. PATENT DOCUMENTS 2,590,754 A * 3/1952 Cline ..... 96/212
2,765,867 A * 10/1956 Cornelis et al. ..... 96/177
3,060,722 A 10/1962 Migdal
5,085,677 A * 2/1992 Ville et al. ..... 96/210
5,203,891 A * 4/1993 Lema ..... 96/210
6,402,799 B1 * 6/2002 Kokubo et al. ..... 55/396

* cited by examiner

*Primary Examiner*—Duane Smith
*Assistant Examiner*—Douglas J Theisen
(74) *Attorney, Agent, or Firm*—W. Warren Taltavull; Manelli Denison & Selter PLLC

(57) ABSTRACT

A centrifugal gas/liquid separator for location in a liquid reservoir comprises a generally cylindrical wall defining a separation chamber having a closed end, an open end, an inlet in the cylindrical wall for supplying a gas/liquid mixture into the separation chamber, and a gas outlet located externally of the separation chamber for discharging gases from the separator. The separator defines at least one liquid flow path for conveying separated liquid from the open end of the separation chamber into a reservoir, and at least one gas flow path for conveying separated gases from a radially inner region of the open end of the separation chamber, externally of the separation chamber, to the gas outlet. The separator is particularly suitable for separating air/oil mixtures in an oil system of a gas turbine engine.

29 Claims, 3 Drawing Sheets

CENTRIFUGAL GAS/LIQUID SEPARATORS

FIELD OF THE INVENTION

The present invention relates to a centrifugal gas/liquid separator and particularly, but not exclusively, to a centrifugal air/oil separator for use in gas turbine engines.

BACKGROUND OF THE INVENTION

Gas turbine engines conventionally include pressurised oil systems for delivering oil to the components of the engine which require lubrication, such as the bearings and gearbox, for example. In use, the oil is pumped from an engine oil tank to the components and, during lubrication, air is entrained in the oil flow thus forming an air/oil mixture.

Since the oil system is a closed loop system, the air/oil mixture is returned to the oil tank. Since it is undesirable for the oil in the tank to contain air, an air/oil separator, also known as a de-aerator, is used to separate the air/oil mixture.

It is known to locate a centrifugal air/oil separator within an oil tank to separate the air/oil mixture returning to the tank. A known air/oil separator comprises a cylindrical separation chamber in which separation of the air/oil mixture occurs. An air outlet for discharging separated air is located within the separation chamber, and separated oil returns to the tank from an open end of the chamber.

One disadvantage of this known air/oil separator is that oil is entrained in the flow of separated air and is discharged from the air outlet with the air. Another disadvantage is that the separated oil discharged from the separator causes disturbance of the oil already present in the oil tank.

It would therefore be desirable to provide a centrifugal gas/liquid separator which minimises the amount of liquid discharged with the separated gas and also minimises the disturbance of the liquid in the reservoir in which the separator is located.

SUMMARY OF THE INVENTION

According to the present invention, there is provided a centrifugal gas/liquid separator for location in a liquid reservoir, the separator comprising a generally cylindrical wall defining a separation chamber having a closed end and an open end, an inlet in the cylindrical wall for supplying a gas/liquid mixture into the separation chamber, characterised in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet.

Preferred features of the invention are defined in the accompanying claims.

BRIEF DESCRIPTION OF THE DRAWINGS

An embodiment of the present invention will now be described by way of example only and with reference to the accompany drawings, in which:—

DETAILED DESCRIPTION OF THE INVENTION

Figure 1:
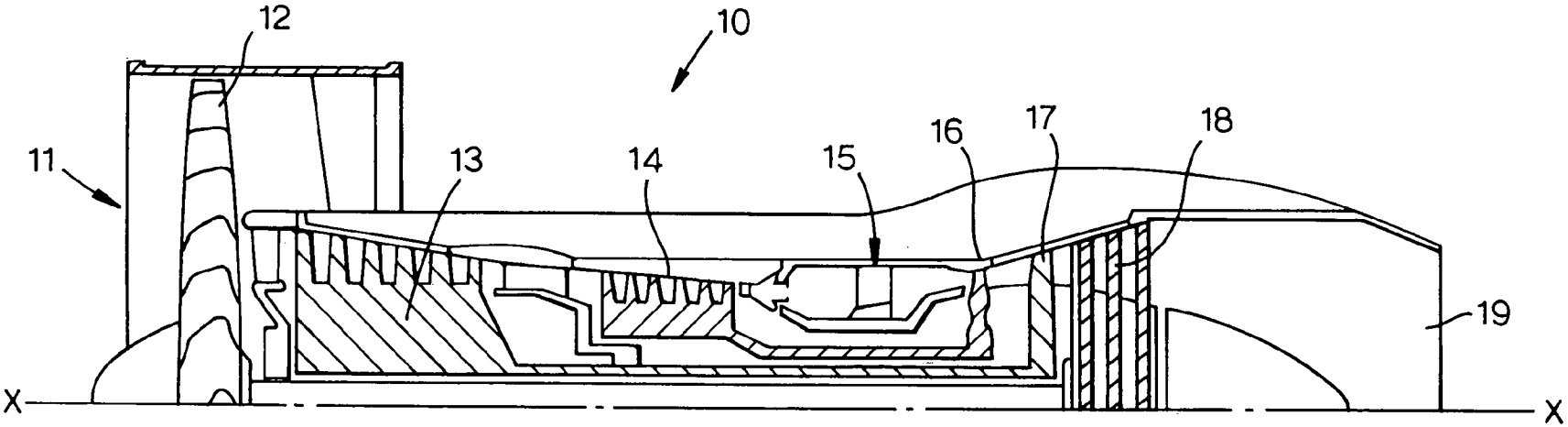
FIG. 1 is a diagrammatic cross-sectional view of a part of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13, and the fan 12 by suitable interconnecting shafts.

Figure 2:
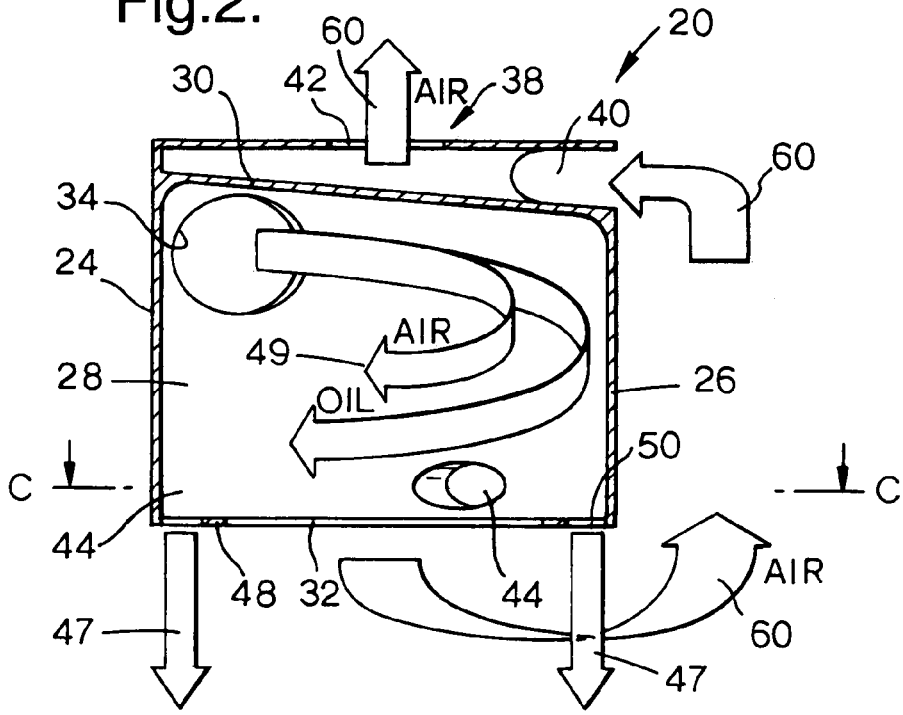
FIG. 2 is a diagrammatic cross-sectional view of a gas/liquid separator according to the invention.
Figure 3:
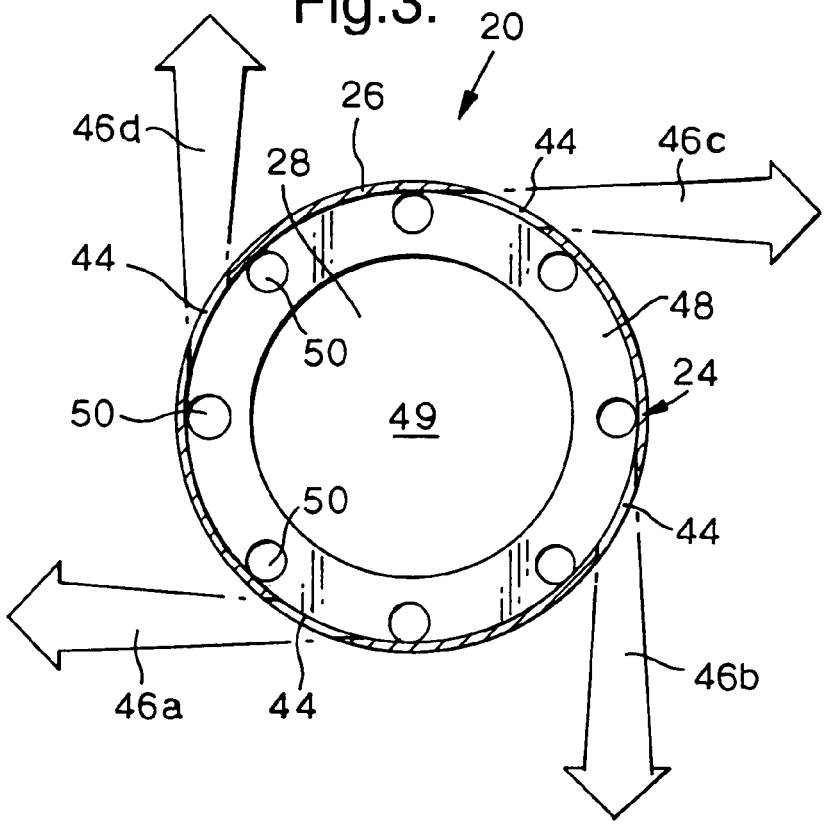
FIG. 3 is a cross-sectional view along line C-C of FIG. 2.
Figure 4:
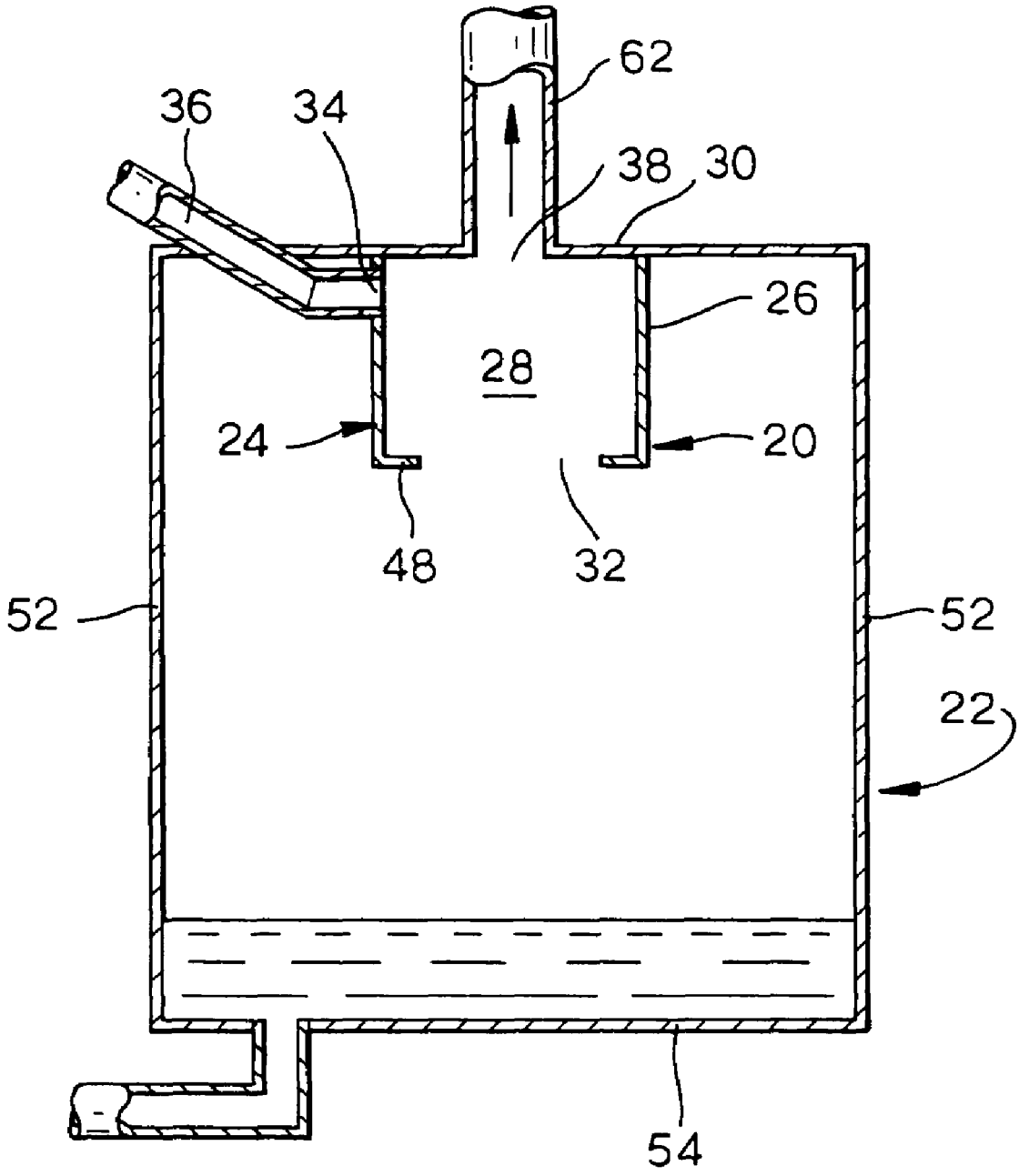
FIG. 4 is a diagrammatic cross-sectional view of an oil tank assembly including the gas/liquid separator of FIGS. 2 and 3.

FIGS. 2 to 4 show generally a centrifugal gas/liquid separator 20 for location in a liquid reservoir, for example an oil tank 22, of a gas turbine engine such as the gas turbine engine 10. The separator 20 may of course be used in any suitable gas turbine engine. The separator 20 is particularly intended for separating an air/oil mixture returned to the oil tank 22, and the following description is provided with that specific application in mind. However, those skilled in the art will appreciate that the centrifugal gas/liquid separator 20 may be used for separating any suitable gas/liquid mixture and may be located in any suitable reservoir.

The separator 20 comprises a generally cylindrical body 24 having a cylindrical wall 26, the wall 26 defining a separation chamber 28 into which a gas/liquid mixture to be separated is directed. The separation chamber 28 has a closed end 30 which, when the separator 20 is mounted for use in the oil tank 22, is the upper end, and also has an open end 32 which, when the separator 20 is mounted for use in the oil tank 22, is the lower end.

The cylindrical wall 26 includes an inlet 34 which, in use, is connected to a common scavenge return pipe 36 of the gas turbine engine 10. The common scavenge return pipe 36 feeds the gas/oil mixture into the separation chamber 28 through the inlet 34. As best seen in FIG. 2, the inlet 34 is in the form of a generally tangential aperture and is arranged so that the gas/oil mixture fed into the separator 20 swirls around inside the separation chamber 28 to thereby form a vortex, as will be described in more detail later.

The separator 20 further comprises a gas outlet 38 for discharging separated gases. In use, separated gases are discharged from the outlet 38 along a vent pipe 62 into a breather (not shown) of the gas turbine engine 10. As is clearly illustrated in FIG. 2, the gas outlet 38 is located externally of the separation chamber 28 adjacent the closed, or upper, end 38 of the separator 20. The gas outlet 38 comprises a first opening 40 in the form of a slot which extends partly around the circumference of the separator 20, and a second generally circular opening 42 which is generally aligned with, and parallel to, the central longitudinal axis of the separation chamber 28, and which is in communication with the first opening 40.

The cylindrical wall 26 includes a plurality of liquid discharge ports 44 which are generally tangential and spaced around the cylindrical wall 26 adjacent the open end 32. The liquid discharge ports 44 thus define a plurality of first liquid flow paths 46*a-d* for separated oil which are generally tangential to the cylindrical wall 26, as best seen in FIG. 3. In use, the first liquid flow paths 46*a-d* are generally horizontal and direct separated oil from the separation chamber 28 towards the walls 52 of the oil tank 22, as will be described in detail hereinafter.

The separator 20 also includes a liquid flow guide 48 at the open, or in use lower, end 32 of the separation chamber 28. The liquid flow guide 48 comprises a generally annular ring and includes a plurality of apertures 50 which define a plurality of second liquid flow paths 47, two of which are shown in FIG. 2, for separated oil. The longitudinal axis of each of the apertures 50 is generally parallel to the central longitudinal axis of the separation chamber 28 such that when the separator 20 is mounted for use in the oil tank 22, separated oil is directed along the second liquid flow paths 47 generally vertically downwardly.

In use, the separator 20 is mounted in the oil tank 22 of the gas turbine engine 10 in an upper region of the tank 22. As explained, the common scavenge return pipe 36 feeds the gas/oil mixture into the separation chamber 28 via the inlet 34. A vortex flow of the gas/oil mixture is established within the separation chamber 28 and the gas/oil mixture is caused to separate. Due to centrifugal motion, the separated oil tends to move outwardly towards the inner surface of the cylindrical wall 26 of the separation chamber 28 whilst the separated gases tend to move inwardly towards a radially inner region 49 of the separation chamber 28.

Some of the separated oil, for example in the order of approximately 50% of the oil contained in the gas/oil mixture, exits the separation chamber 28 through the liquid discharge ports 44 and flows along the plurality of first liquid flow paths 46*a-d*. It is however envisaged that any amount of oil between 30% and 50% of the oil contained in the gas/oil mixture may exit the separation chamber 28 through the liquid discharge ports 44. As already mentioned, as the separated oil flows along the first liquid flow paths 46*a-d*, it is directed towards the walls 52 of the oil tank 22.

Once the separated oil has impacted the walls 52, it flows slowly down the walls 52 towards the base 54 of the tank 22 where it merges with the oil already present in the tank. Due to the low velocity at which the separated oil flows down the walls 52, any remaining gases trapped in the oil are released thus minimising aeration of the oil reservoir in the tank 22. Furthermore, the separated oil merges with the oil reservoir at low velocity. This minimises disturbance of the oil reservoir and thus further contributes to minimising aeration of the oil.

Some of the separated oil, for example in the order of approximately 40% of the oil contained in the gas/oil mixture, exits the separation chamber 28 through the apertures 50 in the liquid flow guide 48 thus causing the separated oil to flow along the plurality of second flow paths 47. It is however envisaged that any amount of oil between 20% and 70% of the oil contained in the gas/oil mixture may exit the separation chamber 28 through the apertures 50 in the liquid flow guide 48. As mentioned above, the separated oil is directed in use along the second liquid flow paths 47 towards the base 54 of the tank 22, and the separated oil thus flows vertically downwardly and impacts directly on the surface of the reservoir of oil already present in the tank.

The liquid flow guide 48 also acts as a flow restrictor and causes some of the oil flowing down the inner surface of the cylindrical wall 26 and impinging upon the guide 48 in areas where there are no apertures 50 to be directed back up the cylindrical wall 26, away from the open end 32. This tends to increase the amount of separated oil leaving the separation chamber 28 through the discharge ports 44 along the first liquid flow paths 46*a-d*.

Since the separated oil is only able to flow vertically downwardly through the apertures 50 of the liquid flow guide 48, it prevents the formation of a curtain of oil and thus enables gases separated from the gas/oil mixture to escape from the separation chamber 28 without disturbing the flows of separated oil, as will now be described.

As discussed above, gases separated from the gas/oil mixture are caused by centrifugal motion to move inwardly towards the radially inner region 49 of the separation chamber 28. The separated gases thus exit the separation chamber 28 from the radially inner region 49 of the open end 32 of the separation chamber and pass along at least one gas flow path 60, defined by the separator 20. The gas flow path 60 conveys the separated gases from the radially inner region 49 of the open end 32 of the separation chamber 28, around the edge of the cylindrical wall 26 at the open end 32, externally of the separation chamber 28 and generally upwardly towards the gas outlet 38.

Due to the fact that both the first liquid flow paths 46*a-d* and the second liquid flow paths 47, defined by the liquid flow guide 48, prevent the formation of a curtain of separated oil from exiting the open end 32 of the separation chamber 28, the separated gases flow along the gas flow path 60 by passing adjacent the liquid flow paths and between the liquid flow paths 46*a-d*, 47. This provides the particular advantage that the oil flowing along either of the plurality of the first or second liquid flow paths 46*a-d*, 47 is not disturbed due to impingement of the gas flow path on the liquid flow paths. Minimising disturbance of the separated oil in this way further contributes to maintaining the reservoir of oil present in the oil tank 22 in a settled condition, thus further minimising aeration of the oil.

As the separated gases exit the open end 32 of the separation chamber 28, a small amount of oil may still be present in the gases. As the separated gases flow from the open, or in use lower, end 32 of the separation chamber 28 upwardly towards the gas outlet 38, the velocity of the gas flow decelerates to such an extent that its velocity close to the gas outlet 38 is reduced to approximately zero. This allows some of the remaining oil present in the separated gases to fall from the separated gases, under the action of gravitational force, towards the base 54 of the tank 22 where it merges with the reservoir of oil already present in the tank 22.

The gases leaving the tank 22 along gas flow path 60 thus contain a minimal amount of oil, for example in the order of 10% of the oil present in the gas/oil mixture. Depending upon the physical characteristics of the separator 20 and the characteristics of the gas/liquid mixture, for example gas and liquid densities and/or flow velocity, it is possible that the gases leaving the tank 22 along the gas flow path 60 may contain between 0 and 20% of the oil present in the original gas/oil mixture entering the separator 20. The separated gases are discharged from the tank 22, through the gas outlet 38 and vent pipe 62, which is connected to the gas outlet 38, into the breather, due to the difference between the tank 22 and breather pressures.

There is thus provided a centrifugal gas/liquid separator 20 which, due to the provision of separate gas and liquid flow paths which pass adjacent to each other and due to the provision of the gas outlet 38 externally of the separation chamber 28, minimises, and may completely eliminate, the amount of liquid discharged with the separated gases and also minimises the disturbance of liquid present in the reservoir, for example oil in the oil tank 22 of the gas turbine engine 10, in which the separator 22 is located.

Although embodiments of the present invention have been described in the preceding paragraphs with reference to various examples, it should be appreciated that various modifications may be made to the examples given without departing from the scope of the present invention, as defined in the accompanying claims. For example, in the illustrated embodiment, four liquid discharge ports 44 are provided. It will however be appreciated by those skilled in the art that any number of liquid discharge ports 44 may be provided, and the number selected will be dependent upon the mass flow rates of gas and liquid in the separator 22. Likewise, the liquid flow guide 48 may include any number of apertures 50. The liquid discharge ports 44 may not be tangential and could, for example, be radial.

The liquid flow guide 48 may be positioned so that it defines an angle of greater than 90 degrees with the inner surface of the cylindrical wall 26. In this case, the apertures 50 would cause separated liquid to be directed along the plurality of second liquid flow paths 47 in a direction other than vertically downwards and, instead, outwardly in use towards the walls 52 of the oil tank 22.

As highlighted above, the separator 20 may be used to separate any gas/liquid mixture and is not limited to separating mixtures of gas/oil in the oil tank of a gas turbine engine.

Whilst endeavouring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

We claim:

1. A centrifugal gas/liquid separator for location in a liquid reservoir, the separator comprising a generally cylindrical wall defining a separation chamber having a closed end and an open end, an inlet in the cylindrical wall for supplying a gas/liquid mixture into the separation chamber, characterised in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet wherein the liquid flow path is arranged adjacent the gas flow path.

2. A separator according to claim 1, wherein the liquid flow path comprises a plurality of liquid flow paths.

3. A centrifugal gas/liquid separator for location in a liquid reservoir, the separator comprising a generally cylindrical wall defining a separation chamber having a closed end and an open end, an inlet in the cylindrical wall for supplying a gas/liquid mixture into the separation chamber, characterized in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet wherein said liquid flow path comprises a plurality of liquid flow paths wherein the gas flow path is arranged to pass between the plurality of liquid flow paths.

4. A separator according to claim 1, wherein the liquid flow path comprises a plurality of first liquid flow paths.

5. A separator according to claim 4, wherein the cylindrical wall includes a plurality of liquid discharge ports adjacent the open end of the separation chamber, the liquid discharge ports defining the plurality of first liquid flow paths.

6. A separator according to claim 5, wherein the plurality of liquid discharge ports each extend generally radially or tangentially through the cylindrical wall.

7. A separator according to claim 4, wherein the separator is configured to convey between 30% and 50% of the liquid contained in the gas/liquid mixture supplied to the separation chamber along the plurality of first liquid flow paths.

8. A separator according to claim 7, wherein the separator (20) is configured to convey approximately 50% of the liquid contained in the gas/liquid mixture supplied to the separation chamber along the plurality of first liquid flow paths.

9. A centrifugal gas/liquid separator for location in a liquid reservoir, the separator comprising a generally cylindrical wall defining a separation chamber having a closed end and an open end, an inlet in the cylindrical wall for supplying a gas/liquid mixture into the separation chamber, characterized in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet wherein said liquid flow path comprises a plurality of first liquid flow paths and a plurality of second liquid flow paths.

10. A separator according to claim 9, wherein the separation chamber includes a liquid flow guide at the open end thereof, the liquid flow guide including a plurality of apertures defining the plurality of second liquid flow paths.

11. A separator according to claim 10, wherein the liquid flow guide is generally annular and the apertures extend through the guide generally parallel to the longitudinal axis of the separation chamber.

12. A separator according to claim 9, wherein the separator is configured to convey between 20% and 70% of the liquid contained in the gas/liquid mixture supplied to the separation chamber along the plurality of second liquid flow paths.

13. A separator according to claim 12, wherein the separator is configured to convey approximately 40% of the liquid contained in the gas/liquid mixture supplied to the separation chamber along the plurality of second liquid flow paths.

14. A separator according to claim 1, wherein the separator is configured such that the separated gases discharged from the gas outlet contain between 0 and 20% of the liquid present in the gas/liquid mixture supplied to the separation chamber.

15. A separator according to claim 14, wherein the separator is configured such that the separated gases discharged from the gas outlet contain approximately 10% of the liquid present in the gas/liquid mixture supplied to the separation chamber.

16. A separator according to claim 1, wherein the separator is mounted, in use, in a reservoir such that the closed end of the separation chamber defines an upper end of the separator, and the open end of the separation chamber defines a lower end of the separator.

17. A separator according to claim 16, wherein a plurality of first liquid flow paths are generally horizontal towards side walls of the reservoir.

18. A centrifugal gas/liquid separator for location in a liquid reservoir having a base, the separator comprising a generally cylindrical wall defining a separation chamber having a closed end and an open end, an inlet in the cylindrical wall for supplying a gas/liquid mixture into the separation chamber, characterized in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet wherein the separator is mounted, in use, in a reservoir such that the closed end of the separation chamber defines an upper end of the separator, and the open end of the separation chamber defines a lower end of the separator wherein a plurality of second liquid flow paths are generally positioned vertically downwards towards said base of the reservoir.

19. A centrifugal gas/liquid separator for location in a liquid reservoir, the separator comprising a generally cylindrical wall defining a separation chamber having a closed end and an open end, an inlet in the cylindrical wall for supplying a gas/liquid mixture into the separation chamber, characterized in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet wherein the separator is mounted, in use, in a reservoir such that the closed end of the separation chamber defines an upper end of the separator, and the open end of the separation chamber defines a lower end of the separator wherein the gas outlet is located at the upper end of the separator and separated gases flow along the gas flow path from the lower open end of the separation chamber, externally of the separation chamber, upwardly towards the gas outlet at the upper end of the separator.

20. A separator according to claim 19, wherein the gas flow path is configured to decelerate the flow of separated gases between the lower and upper ends of the separator.

21. A separator according to claim 20, wherein the gas flow path is configured to decelerate the flow of separated gases by a sufficient amount to enable liquid entrained in the flow of separated gases to fall vertically downwards due to gravity.

22. A centrifugal gas/liquid separator for location in a liquid reservoir, the separator comprising a generally cylindrical wall defining a separation chamber having a closed end and an open end, an inlet in the cylindrical wall for supplying a gas/liquid mixture into the separation chamber, characterized in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet wherein the gas outlet comprises a first opening extending around part of the circumference of the separator adjacent the closed end of the separation chamber.

23. A separator according to claim 22, wherein the gas outlet comprises a second opening, in communication with the first opening, and extending generally parallel to the central longitudinal axis of the separation chamber.

24. An oil tank assembly for a gas turbine engine, the oil tank assembly comprising an oil tank having tank walls and a base, and a centrifugal gas/liquid separator according to claim 1 for separating a gas/oil mixture supplied to the tank.

25. An oil tank assembly according to claim 24, wherein the separator is located in the oil tank generally at an upper end thereof, away from the tank base.

26. An oil tank assembly for a gas turbine engine, the oil tank assembly comprising an oil tank having tank walls and a base, and a centrifugal gas/liquid separator located in a liquid reservoir, the separator comprising a generally cylindrical wall defining a separation chamber having a closed end and an open end, an inlet in the cylindrical wall for supplying a gas/liquid mixture into the separation chamber, characterized in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet, said gas/liquid separator being provided to separate said gas/liquid mixture supplied to said tank wherein a plurality of first liquid flow paths are arranged to convey separated oil generally towards the tank walls, and a plurality of second liquid flow paths are arranged to convey separated oil generally towards the tank base.

27. An oil tank assembly according to claim 26, wherein the gas outlet is in communication with the interior volume of the tank and is arranged to discharge gases from the interior volume of the tank along with the separated gases from the gas/liquid separator.

28. A gas turbine engine including an oil tank assembly according to claim 24.

29. A centrifugal gas/liquid separator for location in a liquid reservoir, the separator comprising a generally cylindrical wall defining a separation chamber having a closed end and an open end, an inlet in the cylindrical wall for supplying a gas/liquid mixture into the separation chamber, characterized in that the separator comprises a gas outlet located externally of the separation chamber for discharging gases from the gas/liquid separator, the separator defining at least one liquid flow path for conveying separated liquid from the open end of the separation chamber into a reservoir, and at least one gas flow path for conveying separated gases from a radially inner region of the open end of the separation chamber, externally of the separation chamber, to the gas outlet wherein the separation chamber includes a liquid flow guide at the open end thereof, wherein the liquid flow guide includes a plurality of apertures defining a plurality of second liquid flow paths.

* * * * *